United States Patent [19]

Beaudette et al.

[11] 4,069,403

[45] Jan. 17, 1978

[54] SWITCHING APPARATUS FOR ELECTRICALLY CONTACTING CONDUCTIVE TERMINALS ON A CIRCUIT-CARRYING BOARD

[75] Inventors: Real J. Beaudette, San Jose; Harold Patrick Krieg, Sunnyvale, both of Calif.

[73] Assignee: The Singer Company, Binghamton, N.Y.

[21] Appl. No.: 723,252

[22] Filed: Sept. 13, 1976

[51] Int. Cl.[2] ..... H01R 33/54

[52] U.S. Cl. ..... 200/51.12; 200/77; 361/413; 339/75 MP

[58] Field of Search ..... 361/413, 415; 339/75 M, 339/75 MP, 176 MP; 200/76, 77, 51.12

[56] References Cited

U.S. PATENT DOCUMENTS

| | | | |
|---|---|---|---|
| 1,377,639 | 5/1921 | Stirling | 200/77 |
| 2,711,523 | 6/1955 | Willis | 339/75 MP |
| 3,478,301 | 11/1969 | Conrad et al. | 339/176 MP |
| 3,731,252 | 5/1973 | McKeown et al. | 339/75 MP |
| 3,858,957 | 1/1975 | Harwood et al. | 339/176 MP |

*Primary Examiner*—David Smith, Jr.
*Attorney, Agent, or Firm*—Paul Hentzel; James C. Kesterson

[57] ABSTRACT

A vertical array of closely spaced hairpin type contactors are mounted in horizontal channels in a vertical array to contact the closely spaced edge terminals of a vertically mounted circuit board. The hairpin contactors are moved within the channel toward and away from the circuit board by a pivoting toggle which is manually operated by moving a toggle lever back and forth horizontally. Camming surfaces along the hairpin contactors cooperate with camming surfaces along the channel walls (or camming surfaces on the circuit board) to spread and close the hairpin contactor, causing the hairpin contactor to break and make contact with the edge terminals. These camming surfaces plus detents on the toggle mechanism retain the hairpin contactor in defined ON or OFF positions relative to the circuit board.

9 Claims, 5 Drawing Figures

SWITCHING APPARATUS FOR ELECTRICALLY CONTACTING CONDUCTIVE TERMINALS ON A CIRCUIT-CARRYING BOARD

BACKGROUND OF THE INVENTION

1. Field of the Invention

This invention relates to techniques for switching boardmounted circuits, and more particularly to switching devices which access the board along an edge.

2. Discussion of Prior Art and Advantages of Present Invention

Heretofore most switches for printed circuits were located on the front panel because of space and accessibility requirements. Lead wires extend from the panel switches through the main frame to a connector which engaged edge terminals on the circuit board.

It is therefore an object of this invention to provide an edge-mounted switch for circuit boards which interfaces directly with conductors on the circuit board without intervening lead wires and connections.

It is a further object of this invention to provide a zero insertion force switching system which is mounted directly on the circuit board terminals.

Generally the prior art front panel switches were push-operated type requiring peripheral finger tip space, or toggle type requiring sufficient room to be activated by the side of the operators's finger. The size of the switch base, mounting structure, and lead terminals on the inside face of the front panel further prevented positioning these prior art panel switches in close proximity. Large switching matrices were located at the rear of the main frame or on special racks within the main frame.

It is therefore another object of this invention to provide a high-density, edge-switching system for circuit boards.

The prior art front panel switches were fixed in location because they were mounted in holes in the front panel. A major effort was required to reposition a single switch or reorganize a group of switches.

It is therefore a further object of this invention to provide a system of edge switches which can easily be repositioned and relabeled.

Some prior art panel switches were formed by an array of closely spaced slots for receiving small keys or U-shaped pins which engage the edge terminal of a printed circuit board. Traffic controllers employ such pin switches for defining the period of time permitted for a particular traffic phase. The slots in each row are associated with successive stages of a binary counter. Each slot represents a subperiod having twice the duration of the previous slot. The traffic phase period is determined by pinning the proper combination of subperiods. Under field conditions of adverse lighting and weather, the operators have difficulty in pin-pointing the proper slot. Sometimes the constant vibration from heavy truck traffic caused the pins to work loose. Further, the small pins were frequently lost in handling.

It is therefore an additional object of this invention to provide an edge-switching system with captive pins.

It is another object of this invention to provide an edge-switching system with position detents for locking the pin in the desired position.

It is still another object of this invention to provide an array of circuit board switches which provides sensory assurance that the desired switching action has been effected.

BRIEF DESCRIPTION OF THE DRAWING

Further objects and advantages of this invention and the operation of the edge switch will become apparent from the following detailed description taken in conjunction with the drawings in which.

GENERAL OPERATION

Figure 1:
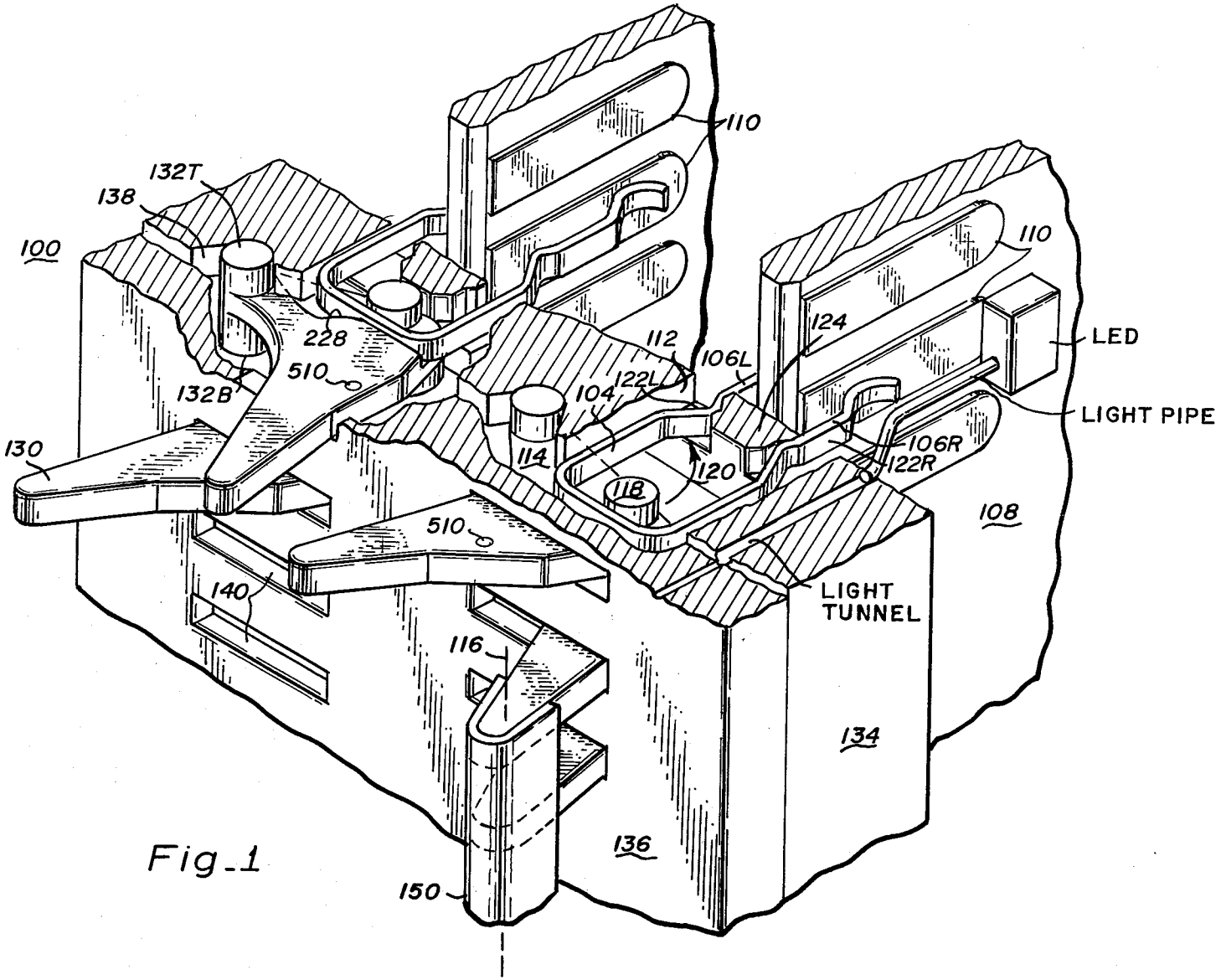
FIG. 1 is a broken-away isometric view showing the edge-switching system.

FIG. 1 shows a two-column edge-switching system 100. The top switches in each column are shown in cutaway view to illustrate the construction of an individual switch in the ON position (LH switch) and in the OFF position (RH) switch). Resilient hairpin conductors 104 have curved legs 106L (left) and 106R (right) extending on either side of vertically-mounted circuit boards 108. The intrinsic resilience of each hairpin conductor 104 urges legs 106 thereof into electrical contact with opposed edge connector strips 110L and 110R positioned on either side of circuit board 108 proximate the edge thereof. Hairpin conductor 104 is moved forward to the OFF position and backward to the ON position in channel 112 by toggle member 114. As toggle member 114 pivots CCW about a vertical axis 116, upright tab 118 moves along a horizontal curved path 120 pulling hairpin connector 104 forward to the OFF position. As hairpin connector 104 moves forward, cams 122L and 112R formed by curves in legs 106 engage spacer 124 causing legs 106 to spread, losing contact with edge connector strips 110. When hairpin connector 104 is full forward in channel 112 the switch is in the OFF position as shown by the top switch of the RH column of system 100. As toggle member 114 pivots CW, rear vertical face 128 thereof pushes hairpin connector 104 backward toward circuit board 108 and leg cams 122 disengage from spacer 124 and close, reestablishing electrical contact with edge connector strips 110. When hairpin connector 104 is fully rearward, the switch is in the ON position as shown by the top switch of the LH column of system 100. The switches are turned ON and OFF by externally moving toggle lever 130 to the right and to the left respectively. Lever 130 extends from toggle member 114 and causes toggle member 114 to pivot about axis 116 on retaining posts 132T (top) and 132B (bottom). Posts 132 are retained between a stationary frame member 134 and removable face plate 136 preferably nestled in a notch 138 in frame member 134. Levers 130 protrude through slots 140. The left-to-right motion of toggle levers 130 in the vertical column embodiment of FIGS. 1 and 2 affects the alignment of levers 130, readily disclosing to the operator the status of the switches in switching system 100. The in-and-out motion of prior art switch levers is not as easily discernible at a glance because the operator is required to perceive the depth position of the operating lever, rather than the lateral displacement.

Lever coupler 150 shown in the FIG. 1 embodiment illustrates one method of ganging the movement of adjacent switches which are always in the same forward or rearward position. Lever coupler 150 permits the operator to simultaneously change the state of a plurality of switches in a single transaction with switching system 100. Unganged prior art switches had to be individually switched sequentially in time which required special time and attention, and failed to insure simultaneous switching where required by the underlying circuitry on circuit board 108.

ON-OFF DETENT

Figure 2:
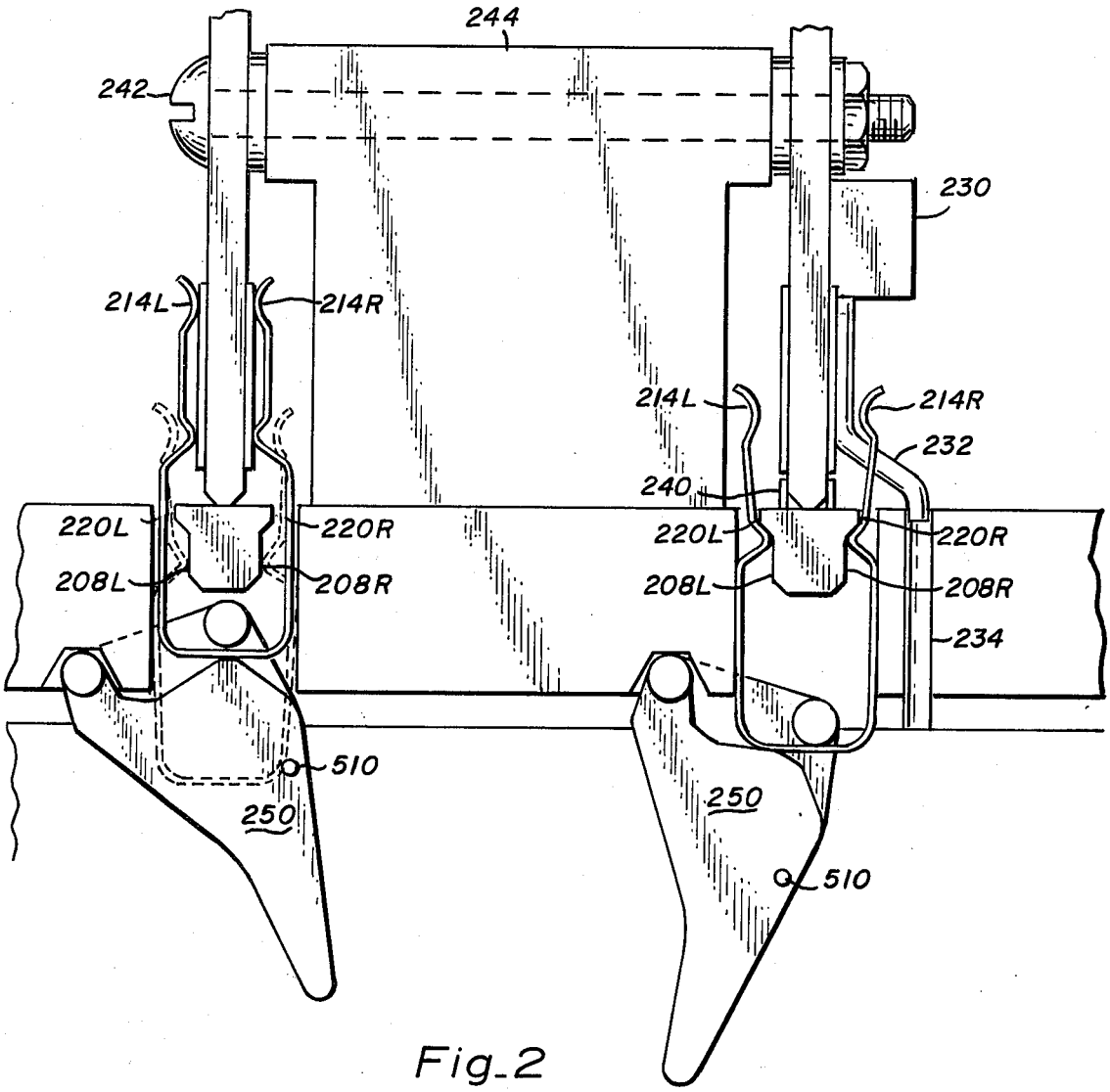
FIG. 2 is a top view of the FIG. 1 system showing the LH switch in the ON position and the RH switch in the OFF position.

FIG. 2 shows a top view of FIG. 1 switching system 100. Leg cams 122L and 122R of the RH switch engage spacer 124 along OFF rest surfaces 208L and 208R. Legs 106 terminate in finger contacts 214L and 214R which are displaced from edge connector strips 110 due to the spreading action of OFF rest surfaces 208 on legs 106. Detent steps 220L and 220R formed on spacer 126 prevent hairpin connector 104 from moving easily inward to the ON position (as shown by the LH switch) in response to bumps, vibrations, or mild forces inadvertently applied to lever 130. A definite force must be applied to lever 130 to overcome detent steps 220 and move hairpin connector 104 inward to the ON position or outward to the OFF position. As leg cams 122 pass over detent steps 220 the resilience of hairpin connector 104 causes connector 104 to snap into place — into either the ON position or the OFF position. This snapping action locks hairpin connector 104 in place and preferably can be felt and heard by the operator to assure the operator that the switch has seated into the new position.

Visual assurance may be provided by a suitable light source such as LED 230 mounted proximate each switch as shown in FIG. 1 and 2. When LED 230 is activated by the adjacent switch, light pipe 232 conducts the light therefrom to light tunnel 234 in frame 134. The operator views this light through panel aperture 236.

The ON-OFF detent feature permits circuit board 108 to be replaced on frame 134 with zero or minimal force. All of the switches in a column associated with the circuit board to be mounted are placed in the OFF position, causing legs 106 of all of the hairpin connectors 104 to spread because of the engagement of legs cams 122 with OFF rest surfaces 208. Hairpin connectors 104 are loosely constrained within boundaries defined by detent steps 220 (which prevents inward motion), ON face 128 of toggle 114 (which prevents outward motion), and side walls 226L and 226R of channel 112 (which prevents skew motion). The looseness of the constraint permits some play in the position of finger contacts 214. As circuit board 108 is inserted between opposed pairs of finger contacts 214, contacts 214 may easily be nudged aside to accommodate imprecise alignment and positioning of board 108, and warpage of board 108. Warp guides or tabs 240 spaced along frame 134 urge board 108 into proper alignment. Board 108 is then secured to 134 by a suitable mechanism such as bolt 242 extending through mounting lugs 244 formed on frame 134.

The sliding motion of hairpin connector 104 causes contact fingers 214 to slide into and out of engagement with edge connector traces 110. This sliding or wiping contact establishes a self-cleaning action each time contact is made or broken to remove small dust particles, loose oxide, and the like from the contact areas of contact finger 214 and connector strip 110. The wiping-cleaning action is enhanced by the internal resilience of hairpin connector 104 which are preferably formed of a highly resilient material such as an alloy of beryllium and copper (one-quarter hard).

ASSEMBLY TECHNIQUE

Each switching system 100 may have one or many rows, each with one or a plurality of selectively located switches. Some applications will require a great number of small parts (toggles 114 and connectors 104) mounted close together in proper alignment to receive face plate 136. Hairpin connectors 104 cooperat with spacers 126 to facilitate this assembly as described in the following steps:

1. Support frame 134 in the horizontal position, front facing upwards without face plate 136 and either with or without circuit boards 108.
2. Insert hairpin connectors 104 into the selected channels 112 with legs 106 engaging spacer 126 to retain connectors 104 in an ASSEMBLE position. This retention may be accomplished by cams 122 engaging the forward portion of OFF rest surfaces 208 as shown by dotted line 250 in FIG. 2. Alternatively the ASSEMBLE position may be established by finger contacts 214 engaging OFF rest surfaces 208 or detent steps 220.
3. Position each toggle 114 in place with post 132 nested in notch 138 and the yoke of hairpin connector 104 engaging toggle 114 between OFF tab 118 and ON face 128.
4. Pivot each toggle towards the ON position moving hairpin connector 104 further into channel 112 until cams 122 engage the rearward portion of OFF rest surfaces 208 (as shown in solid lines in FIG. 2). At this point toggle 114 is locked into engagement with frame 134 because OFF tab 118 is at least partially positioned within channel 112. Preferably this orientation of toggles 114 positions lever 130 in a generally vertical position.
5. Mount face plate 136 onto frame 134 negotiating vertical levers 130 through face plate slots 140.

CONTACTOR 104 MODIFICATIONS

Figure 3:
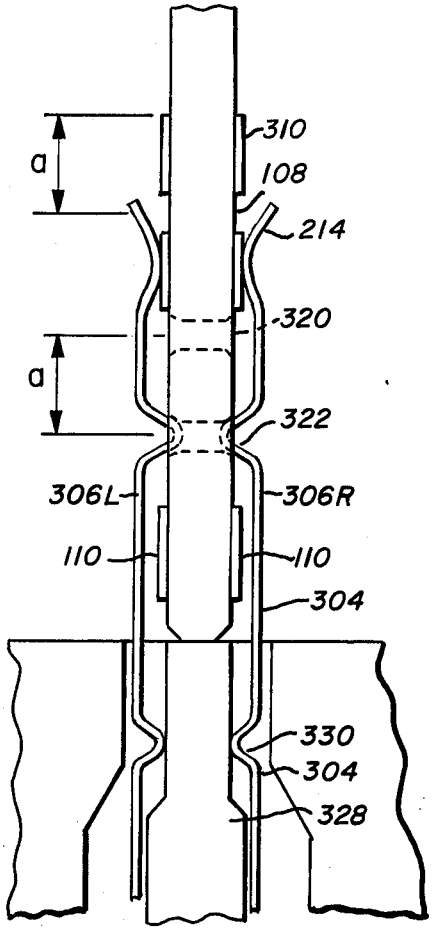
FIG. 3 is a fragmentary view of an interior switching embodiment showing a forked connector with extended prongs.

FIG. 3 shows an interior switch 300 having forked connector 304 with extended legs or prongs 306 for reaching beyond edge traces 110 to a series of interior contacts 310. Edge traces 110 remain available for its conventional function. Alternatively, interior switch 300 may be employed along an accessible but unused edge of circuit board 108 without edge connector trace 110. Switch position detents are formed by suitable indentations in circuit board 108 along the path of travel such as holes 320 which cooperate with position cams 322 on prongs 306. In the embodiment shown, switch 300 is a DPDT having two positions and two sets of contacts. Many other switching configurations may be employed. Interior switch 300 has a full forward position (away from board 108) in which forward spacer 328 engages forward cams 330 to spread prongs 306. In the full forward position circuit board 108 may easily be removed or inserted. If desired, prongs 306 may be sufficiently spread to avoid contacting or rubbing against edge traces 110.

Figure 4:
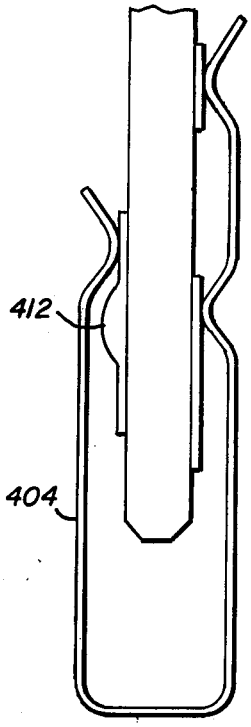
FIG. 4 is a fragmentary view showing a nonsymmetrical embodiment of the edge switch.

FIG. 4 shows a nonsymmetrical forked connector 404 which connects circuits on the same side of circuit board 108 as well as circuits on opposite sides. A nonsymmetrical position detect structure is provided by bumb 412.

DETENT DIMPLE 510

Figure 5:
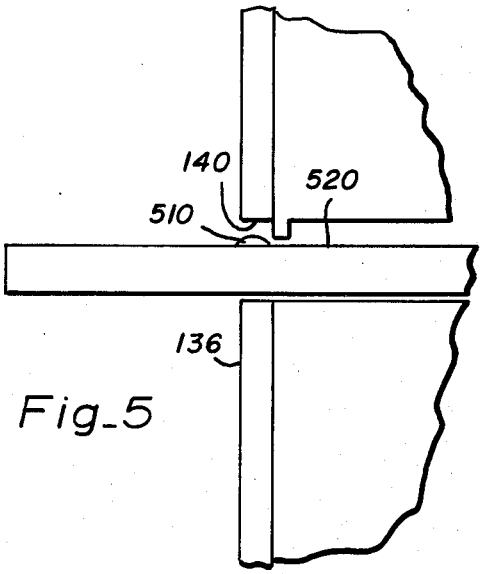
FIG. 5 is a side view of a portion of FIG. 1 showing position defining dimple.

FIG. 5 is a side view of FIG. 1 switching system 100 showing detent dimple 510 formed on the top surface of toggle member 114. Dimple 510 engages downwardly extending ridge 520 formed on the top surface of channel 112 proximate slot 140. As toggle member 114 is moved horizontally, dimple 519 momentarily engages ridge 520. The increased force required to enable dimple 510 to move past ridge 520 defines a toggle position on either side of ridge 520. These dimple-ridge positions are in addition to the cam-step positions described in connection with FIG. 2.

It will be apparent to those skilled in the art that various changes may be made in the apparatus and operation thereof without departing from the scope of the invention. For example, switching system 100 has been described as vertical columns of switches with left and right motion, but the present inventive concept clearly includes rows or horizontal switches with up and down motion. Further, an endless variety of cams, dimples and steps may be employed to position and spread hairpin connectors 104 of the present invention. Accordingly, the scope of this invention should be determined by the wording of the following claims and their equivalents.

We claim:

1. An electrical switch for contacting edge contact strips on a conductor-carrying medium comprising:

a support member with a channel means therethrough having a floor which defines a plane of motion and two spaced walls;

a resilient, forked, conductive member movably retained within the channel and having at least two prong portions connected by a yoke portion, the prong portions supported by the floor and generally movable along the plane of motion while guided by the spaced walls, and adapted to receive and engage opposed surfaces of the conductor-carrying medium, at least one of the two prong portions adapted to contact a conducting terminal on the conductor-carrying medium proximate the edge thereof;

a toggle member mounted on the support member and pivotal about an axis of pivot;

engaging means carried on the toggle member at a position offset from the axis of pivot for rotatably engaging the forked conductive member;

a lever portion extending from the toggle member and adapted to be externally moved to pivot the toggle member causing the engaging means to move the forked conductive member along a travel path within the channel along the plane of motion in an outward direction away from the conductor-carrying medium or in an inward direction toward the conductor-carrying medium;

camming means on at least one of the prong portions; and displacing means formed within the channel means by the contour of at least one of the spaced walls for engaging the camming means on the prong portions causing the prong portions of the forked member to move relative to one another to engage and disengage the opposed surfaces of conductor-carrying medium as the forked conductive member moves along the travel path.

2. The electrical switch of claim 1, wherein the channel means has an island portion therein forming a subchannel for each prong.

3. The electrical switch of claim 2, wherein the displacing means is formed on at least one wall of the island portion of the channel means for engaging the inside surface of the forked conductive member for causing the prongs thereof to spread and disengage from the surface of the conductor-carrying medium.

4. The electrical switch of claim 1, wherein the engaging means is an open-ended cavity for receiving the yoke portion of the forked conductive member formed by:

a forward-facing surface which engages the yoke of the forked conductive member and causing the forked conductive member to slide in a forward direction away from the conductor-carrying medium; and a rearward facing surface which engages the yoke of the forked conductive member causing the forked conductive member to slide within the channel means in a rearward direction toward the conductor-carrying medium.

5. The electrical switch of claim 4, wherein each leg of the forked conductive member has a camming means thereon for temporarily engaging the displacing means as the forked conductive member slides within the channel.

6. The electrical switch of claim 5, wherein the camming means on the first prong portion are symmetrically positioned with respect to the corresponding camming means on the second prong portion along a plane of symmetry which extends between the prong portions and through the plane of motion.

7. The electrical switch of claim 6, wherein the plane of symmetry is perpendicular to the plane of motion and bisects the channel means.

8. The electrical switch of claim 5, wherein the forked conductive member has a generally U-shaped configuration formed by a strand of conductive metal.

9. The electrical switch of claim 8, wherein the camming means of each leg of the forked conductive member is formed by bends in the strand of conductive material.

* * * * *